US007288890B2

(12) United States Patent
Ahn

(10) Patent No.: US 7,288,890 B2
(45) Date of Patent: Oct. 30, 2007

(54) PLASMA DISPLAY PANEL INCLUDING UNGROUNDED FLOATING ELECTRODE IN BARRIER WALLS

(75) Inventor: Jeong-Chull Ahn, Cheonan-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 481 days.

(21) Appl. No.: 10/896,229

(22) Filed: Jul. 22, 2004

(65) Prior Publication Data

US 2005/0023977 A1 Feb. 3, 2005

(30) Foreign Application Priority Data

Jul. 29, 2003 (KR) ..... 10-2003-0052445

(51) Int. Cl.
*H01J 17/49* (2006.01)

(52) U.S. Cl. ..... 313/582; 313/583
(58) Field of Classification Search ..... 313/582–587
See application file for complete search history.

(56) References Cited

U.S. PATENT DOCUMENTS

| | | | |
|---|---|---|---|
| 5,541,618 | A | 7/1996 | Shinoda |
| 5,661,500 | A | 8/1997 | Shinoda et al. |
| 5,663,741 | A | 9/1997 | Kanazawa |
| 5,674,553 | A | 10/1997 | Sinoda et al. |
| 5,724,054 | A | 3/1998 | Shinoda |

(Continued)

FOREIGN PATENT DOCUMENTS

| | | |
|---|---|---|
| JP | 02-148645 | 6/1990 |
| JP | H02-119343 | 9/1990 |

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Vip Patel
(74) *Attorney, Agent, or Firm*—Robert E. Bushnell, Esq.

(57) ABSTRACT

A plasma display panel, which enables low voltage addressing and reduces deterioration of the fluorescent layers, thereby achieving excellent luminance, includes: a front substrate having sustaining electrodes arranged at predetermined intervals; a front dielectric layer adapted to bury the sustaining electrodes; a rear substrate facing the front substrate and including address electrodes arranged orthogonal to the sustaining electrodes; a rear dielectric layer adapted to bury the address electrodes; barrier walls adapted to define stripe-shaped discharge spaces arranged between the front substrate and rear substrate, the stripe-shaped discharge spaces being parallel to and alternating with the address electrodes; fluorescent layers arranged within the discharge spaces; and at least one floating electrode respectively arranged within the barrier walls in a longitudinal direction of the barrier walls. Alternatively, first and second barrier walls can be adapted to define discharge spaces arranged between the front substrate and rear substrate, the first barrier walls arranged parallel to and alternating with the address electrodes, and the second barrier walls arranged perpendicular to the first barrier walls and at least one floating electrode respectively arranged within the first and second barrier walls and in a longitudinal direction of the first and second barrier walls.

15 Claims, 7 Drawing Sheets

U.S. PATENT DOCUMENTS

| | | | | |
|---|---|---|---|---|
| 5,786,794 | A | 7/1998 | Kishi et al. | |
| 5,952,782 | A | 9/1999 | Nanto | |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 2002/0145387 | A1* | 10/2002 | Akiba | 313/586 |
| 2002/0163304 | A1* | 11/2002 | Akiba | 313/584 |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |
| KR | 2002-0008253 | 1/2002 |

* cited by examiner

PLASMA DISPLAY PANEL INCLUDING UNGROUNDED FLOATING ELECTRODE IN BARRIER WALLS

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 29 Jul. 2003 and there duly assigned Serial No. 2003-52445.

BACKGROUND OF THE INVENTION

1. Field of the Invention

The present invention relates to a plasma display panel (PDP), and more particularly to a PDP having reduced fluorescent substance deterioration and having low voltage addressing.

2. Description of the Related Art

When voltage is applied across two electrodes arranged in a sealed space filled with gas within a PDP, a glow discharge occurs which creates ultra violet rays, which excite fluorescent layers that are arranged in a predetermined pattern, thereby creating an image.

PDPs can be categorized into direct current PDPs, alternating current PDPs, or hybrid PDPs, depending on how they are driven. Depending on the electrode structure, PDPs can also be categorized into a PDP that has at least two electrodes to perform a discharge operation or a PDP that has three electrodes. An auxiliary electrode is added to induce an additional discharge in a direct current PDP. An address electrode is added to increase the address rate by separating a select discharge from a sustain discharge in an alternating current PDP.

In addition, depending on the arrangement of the discharge electrodes, PDPs can be categorized into a face discharge PDP or a surface discharge PDP. In a face discharge PDP, two sustaining electrodes are respectively located on a front substrate and rear substrate, thereby causing a discharge perpendicular to the panel. In a surface discharge PDP, two sustaining electrodes are located on the same substrate, thereby causing a discharge on the surface of the substrate. Such a PDP is partitioned into discharge cells by barrier walls arranged between the front substrate and rear substrate.

There have been continuous efforts to reduce discharge interference and mis-discharge in PDPs. For example, a PDP referred to in Japanese Laid-Open Patent Publication No. 2001-216902 is provided with a floating electrode arranged on the upper side of the discharge cell, the floating electrode pulling the discharge and preventing discharge interference with neighboring discharge cells.

SUMMARY OF THE INVENTION

The present invention provides a plasma display panel (PDP) including floating electrodes arranged inside barrier walls, thereby enabling low voltage addressing and reducing deterioration of fluorescent layers.

The present invention also provides a PDP including floating electrodes arranged within a barrier wall, thereby increasing the supporting strength of the panel.

According to an aspect of the present invention, a plasma display panel is provided comprising: a front substrate including sustaining electrodes arranged at predetermined intervals; a front dielectric layer adapted to bury the sustaining electrodes; a rear substrate arranged to face the front substrate and including address electrodes arranged orthogonal to the sustaining electrodes; a rear dielectric layer adapted to bury the address electrodes; barrier walls adapted to define stripe-shaped discharge spaces arranged between the front substrate and rear substrate, the stripe-shaped discharge spaces being arranged parallel to and alternating with the address electrodes; fluorescent layers arranged within the discharge spaces; and at least one floating electrode respectively arranged within the barrier walls and in a longitudinal direction of the barrier walls.

Preferably, a plurality of floating electrodes are arranged at predetermined intervals in an upward and downward direction of the height of each barrier wall.

According to another aspect of the present invention, a plasma display panel is provided comprising: a front substrate including sustaining electrodes arranged at predetermined intervals; a front dielectric layer adapted to bury the sustaining electrodes; a rear substrate arranged to face the front substrate and including address electrodes arranged orthogonal to the sustaining electrodes; a rear dielectric layer adapted to bury the address electrodes; first and second barrier walls adapted to define discharge spaces arranged between the front substrate and rear substrate, the first barrier walls arranged parallel to and alternating with the address electrodes, and the second barrier walls arranged perpendicular to the first barrier walls; fluorescent layers arranged within the discharge spaces; and at least one floating electrode respectively arranged within the first and second barrier walls and in a longitudinal direction of the first and second barrier walls.

Preferably, a plurality of floating electrodes are arranged at predetermined intervals in the first and second barrier walls in an upward and downward direction of the height of the first and second barrier walls.

Preferably, floating electrodes are arranged within both the first and second barrier walls and wherein the floating electrodes arranged within the first barrier wall and the floating electrodes arranged within the second barrier wall are connected to each other.

Preferably, floating electrodes are arranged within both the first and second barrier walls and wherein the floating electrodes arranged within the first barrier wall and the floating electrodes arranged within the second barrier wall are separated from each other.

Preferably, the first and second barrier walls are arranged to partition the discharge space into a matrix form.

According to yet another aspect of the present invention, a plasma display panel is provided comprising: a front substrate including sustaining electrodes; a rear substrate arranged to face the front substrate and including address electrodes; barrier walls adapted to define discharge spaces arranged between the front substrate and rear substrate; fluorescent layers arranged within the discharge spaces; and at least one floating electrode respectively arranged within the barrier walls.

Preferably, the at least one floating electrode is arranged within the barrier walls in a longitudinal direction of the barrier walls.

Preferably, a plurality of floating electrodes are arranged at predetermined intervals in an upward and downward direction of the height of each barrier wall.

According to still another aspect of the present invention, a plasma display panel is provided comprising: a front substrate including sustaining electrodes arranged at predetermined intervals; a rear substrate arranged to face the front substrate and including address electrodes arranged orthogonal to the sustaining electrodes; first and second barrier walls adapted to define discharge spaces arranged between the front substrate and rear substrate, the first barrier walls arranged in parallel and the second barrier walls arranged perpendicular to the first barrier walls; fluorescent layers arranged within the discharge spaces; and at least one floating electrode respectively arranged within the first and second barrier walls and in a longitudinal direction of the first and second barrier walls.

Preferably, a plurality of floating electrodes are arranged at predetermined intervals in the first and second barrier walls in an upward and downward direction of the height of the first and second barrier walls.

Preferably, floating electrodes are arranged within both the first and second barrier walls and wherein the floating electrodes arranged within the first barrier wall and the floating electrodes arranged within the second barrier wall are connected to each other.

Preferably, floating electrodes are arranged within both the first and second barrier walls and wherein the floating electrodes arranged within the first barrier wall and the floating electrodes arranged within the second barrier wall are separated from each other.

Preferably, the first and second barrier walls are arranged to partition the discharge space into a matrix form.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
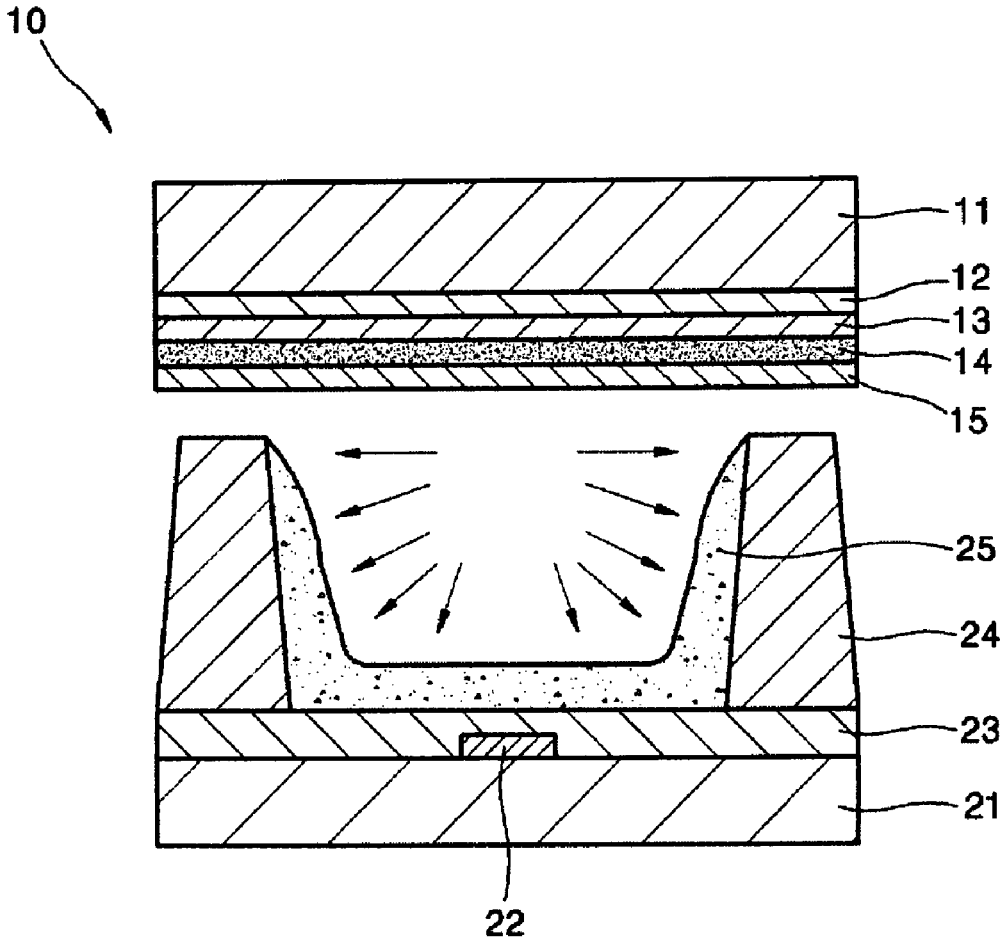
FIG. 1 (PRIOR ART)
FIG. 1 is a cross-sectional view of a discharge cell of a plasma display panel (PDP)

FIG. 1 is a cross-sectional view of a partitioned discharge cell. Referring to FIG. 1, a pair of sustaining electrodes 12 respectively form a common electrode and a scanning electrode and are arranged on a bottom face of a front substrate 11, which is located above a discharge cell 10. Bus electrodes 13 having a voltage applied thereto are arranged on a bottom face of the pair of sustaining electrodes 12. The pair of sustaining electrodes 12 and bus electrodes 13 are buried by a front dielectric layer 14. A protective layer 15 is arranged on the bottom face of the front dielectric layer 14.

The rear substrate 21 is arranged to face the front substrate 11. An address electrode 22 is arranged on the rear substrate 21, and is buried by the rear dielectric layer 23. A barrier wall 24 is arranged on the rear dielectric layer 23 to prevent cross-talk that occurs in the address electrode 22 between adjacent discharge cells. A fluorescent layer 25 of a fluorescent substance is arranged on the inner side of the barrier walls 24. An inert gas is then injected into the discharge cell 10.

A description follows of an operation of a PDP including discharge cells 10 having the structure described above.

An addressing voltage is first applied between the address electrode 22 and the scanning electrode of the sustaining electrode 12, thereby starting a discharge and forming a wall charge in the addressed discharge cell 10. Discharge is maintained by then applying a discharge sustaining voltage between the scanning electrode and common electrode of the sustaining electrode 12. When a discharge occurs, electric charges are created, and the electric charges collide with gas, thereby forming a plasma and creating ultraviolet rays. The ultraviolet rays excite and light up the fluorescent substance of the fluorescent layer 25 to thereby form a picture image.

However, when a discharge occurs in the discharge cells 10 as shown in FIG. 1, electric charges accumulate on the inner side of the barrier walls 24 and this can deteriorate the fluorescent layer 25 arranged on the inner side of the barrier walls 24, and create an after-image, mis-discharge, or discharge interference, thereby reducing luminance.

Figure 2:
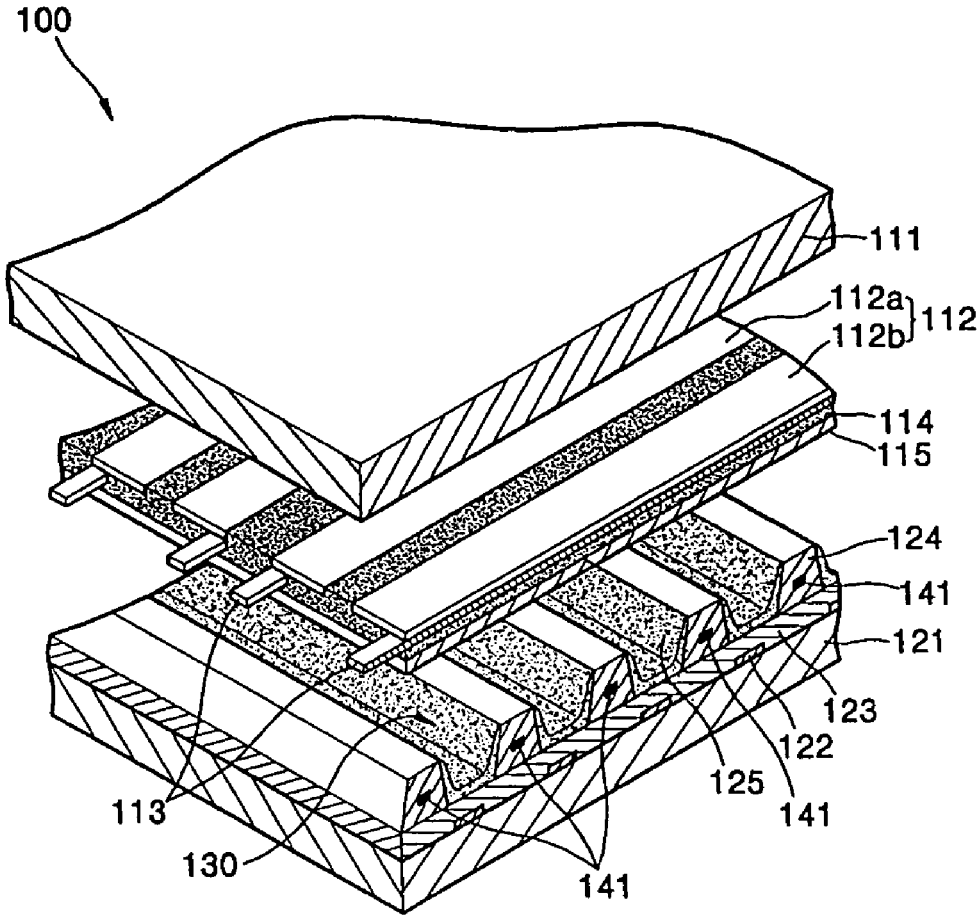
FIG. 2 is an exploded perspective view of a PDP according to a first embodiment of the present invention.

A plasma display panel (PDP) according to a first embodiment of the present invention is shown in FIG. 2. A PDP 100 shown in FIG. 2 includes a front substrate 111, consisting of glass or another transparent material, and a rear substrate 121 facing the front substrate 111. Sustaining electrodes 112 and bus electrodes 113 are arranged under the front substrate 111. There are a plurality of strip-shaped sustaining electrodes 112. The sustaining electrodes 112 can consist of transparent conductive material, for example, an ITO film.

Bus electrodes 113, consisting of a conductive material and having a smaller width than the sustaining electrodes 112, are aligned under the respective sustaining electrodes 112 to reduce line resistance. The bus electrodes 113 can consist of a metal having a good conductivity, such as a silver paste.

The sustaining electrodes 112 each include a common electrode 112*a* and a scanning electrode 112*b*, which alternate in their arrangement. One bus electrode 113 is connected to a common electrode 112*a* and the other adjacent bus electrode 113 is connected to a scanning electrode 112*b*. Sustaining electrodes 112 and bus electrodes 113 are buried in a front dielectric layer 114, which is arranged on the bottom face of the front substrate 111. A protective layer 115, for example, an MgO layer can be additionally arranged beneath the front dielectric layer 114.

A rear substrate 121 is arranged to face the front substrate 111 below the front substrate 111.

Address electrodes 122 are arranged on top of the rear substrate 121 and are buried in a rear dielectric layer 123.

A plurality of strip-shaped address electrodes 122 are arranged orthogonal to the bus electrodes 113. The address electrodes 122 are spaced apart at predetermined intervals. However, the structure of the electrodes is not limited to the above-described embodiment. For example, the bus electrodes 113 can be omitted.

Barrier walls 124 are arranged apart from each other on top of the rear dielectric layer 123. The barrier walls 124 partition the discharge cells 130 into a stripe-shaped discharge spaces located between the front substrate 111 and rear substrate 121.

The barrier walls 124 are arranged between and in parallel with the address electrodes 122. That is, each address electrode 122 is arranged between two barrier walls 124. The form of the barrier walls is not limited to that shown in the drawing figures. Any form of barrier wall that can partition the discharge cells into a pixel alignment pattern can be employed.

A fluorescent layer 125 is arranged in each discharge cell 130, which is partitioned by the barrier walls 124, the fluorescent layer 125 comprising any one of red, green, and blue fluorescent substances. To be more specific, fluorescent layers 125 are arranged on the sides of the barrier walls 124 and on the top surface of the rear dielectric layer 123.

According to one aspect of the present invention, one or more conductive floating electrodes 141 are included in each barrier wall 124. Floating electrodes 141 are buried in each barrier wall 124. It is preferable that strip-shaped floating electrodes 141 be arranged along the barrier walls 124. In addition, it is preferable that the floating electrodes 141 be formed simultaneously with the forming of the barrier walls 124.

Figure 3A:
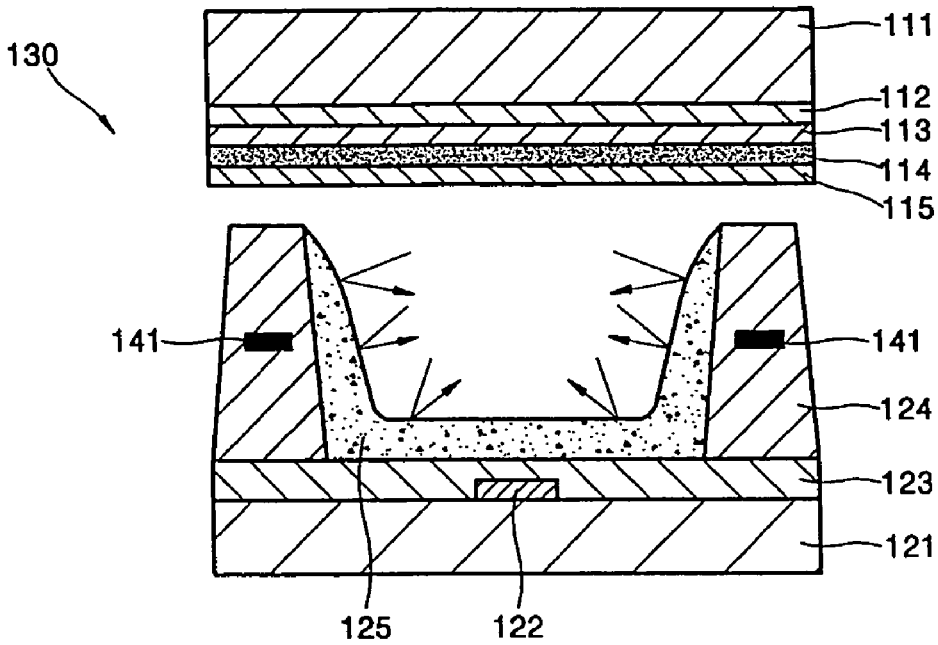
FIG. 3A is a cross-sectional view of a discharge cell in FIG. 2.

FIG. 3A is a cross-sectional view of the structure of the discharge cell 130 of a PDP 100 according to a first embodiment of the present invention.

Referring to FIG. 3A, a discharge cell 130, which is a discharge space, is arranged between two barrier walls 124. Sustaining electrodes 112 arranged on the front substrate 111 and bus electrodes 113 arranged on the bottom surface of the sustaining electrodes 112 are included in the upper portion of the discharge cell 130. The sustaining electrodes 112 and the bus electrodes 113 are buried in the front dielectric layer 114, and a protective layer 115 is arranged on the bottom face of the front dielectric layer 114.

The rear substrate 121 is arranged to face the front substrate 111 and an address electrodes 122 are arranged on the top surface of the rear substrate 121. The address electrodes 122 are arranged between the barrier walls 124 and are buried in the rear dielectric layer 123.

In addition, each barrier wall 124 includes at least one floating electrode 141 buried in the longitudinal direction of the barrier wall 124.

Figure 3B:
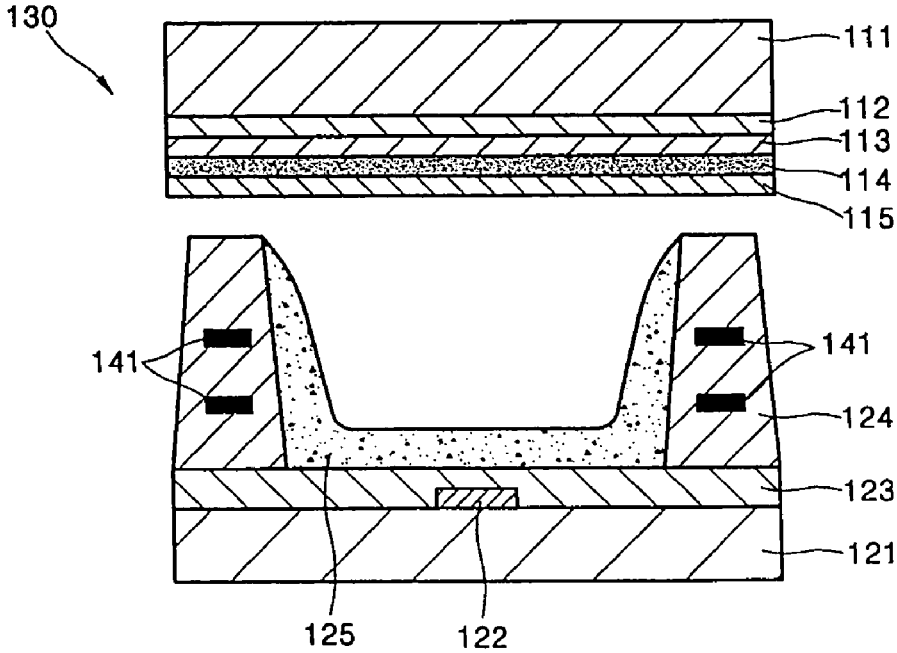
FIGS. 3B through 3D are cross-sectional views of different examples of the discharge cell.
Figure 3C:
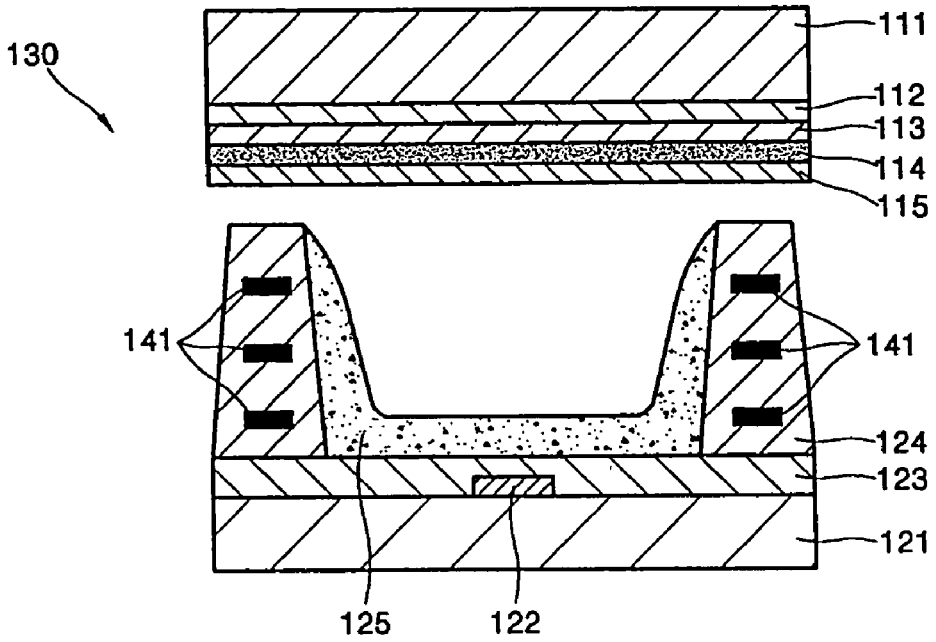
Figure 3D:
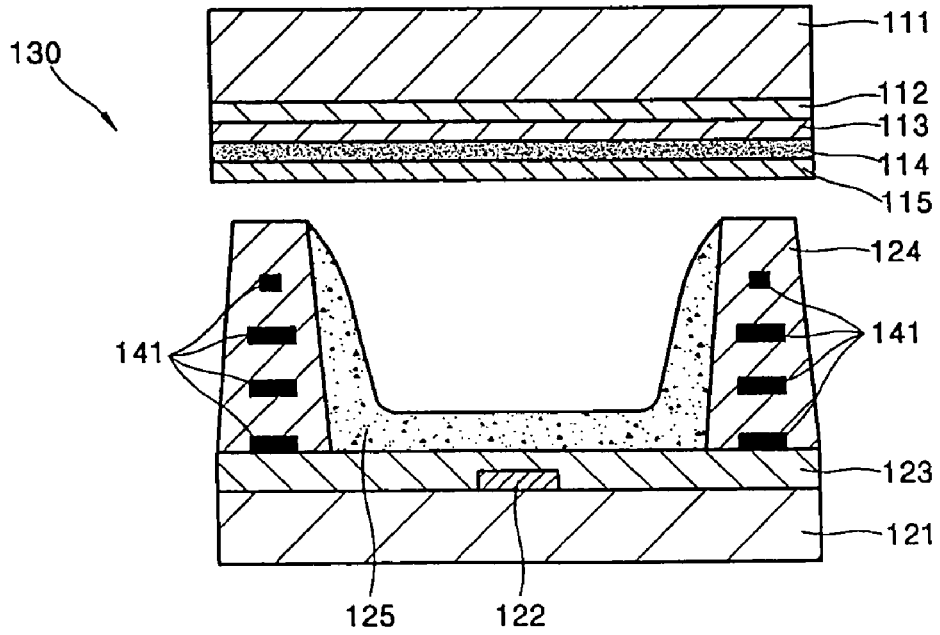

As for the discharge cell 130, each barrier wall 124 is not limited to include only one floating electrode 141 as shown in FIG. 3A but, as shown in FIGS. 3B through 3D, each barrier wall 124 can include a plurality of floating electrodes 141.

In FIGS. 3B through 3D, two, three, and four floating electrodes 141 are respectively buried in each barrier wall 124. When there are a plurality of floating electrodes 141, it is preferable that the floating electrodes 141 are arranged separately at predetermined intervals on top of each other within the barrier wall 124.

Furthermore, as shown in FIG. 3D, when a maximum number of floating electrodes 141 are included, it is preferable to take into account the width of the barrier walls 124 when setting the width of each floating electrode 141.

With the inclusion of floating electrodes 141 in the discharge cell, the large amount of space charges and priming particles created in the discharge cell 130 during an elimination discharge, which eliminates wall charges to turn off the discharge cell 130 after it has been lit, move according to the direction of the arrows shown in FIG. 3A, resulting in active movement. In other words, when a voltage is applied to the sustaining electrodes 112 while the floating electrodes 141 do not receive any external voltage, an induction voltage is generated on the floating electrodes 141. An electric field is generated by such an induction voltage, and due to the generated electric field, space charges and priming particles can move actively into the discharge cell 130. This increases a collision probability per unit time of the space charges and priming particles. Therefore, even when applying half the voltage to the sustaining electrodes 112 and address electrodes 122 as compared to the voltage applied in the prior art, the same effect is achieved, thus having the effect of lowering the addressing voltage.

In addition, unlike the PDP of FIG. 1, space charges and priming particles will not accumulate on the fluorescent layer 125 of the inner side of the barrier walls 124, but will be distributed inside the discharge cell 130 in the direction of the arrows shown in FIG. 3A due to the floating electrodes 141. Therefore, the deterioration of the fluorescent layer 125 is prevented and the occurrence of an after-image, mis-discharge, and discharge interference is also prevented, thereby making it possible to achieve excellent luminance.

The following is a brief description of the operation of a PDP 100 that has the above-described structure.

When an addressing voltage is applied between an address electrode 122 and a scanning electrode 112*b* of a sustaining electrode 112, a discharge occurs and wall charges are arranged in the addressed discharge cell 130. The discharge is maintained by applying a voltage between the common electrode 112*a* and the scanning electrode 1112*b* of the sustaining electrode 112. In this case, electric charges are created and a plasma is generated by the collision of the electric charges and gas. Ultraviolet rays are created, exciting and lighting the fluorescent layer 125, thereby creating an image.

Since floating electrodes 141 are arranged on the inner barrier walls 124 which partition the discharge cell 130, a more active movement of the space charges and the priming particles is possible and a lower voltage can be used for addressing. Space charges and priming particles are distributed within a discharge cell 130, thereby reducing the deterioration of the fluorescent layer 125 and preventing the occurrence of an after-image, mis-discharge, or discharge interference. Also, since floating electrodes 141 are arranged within the barrier walls 124, the supporting strength of the panel is increased.

Figure 4:
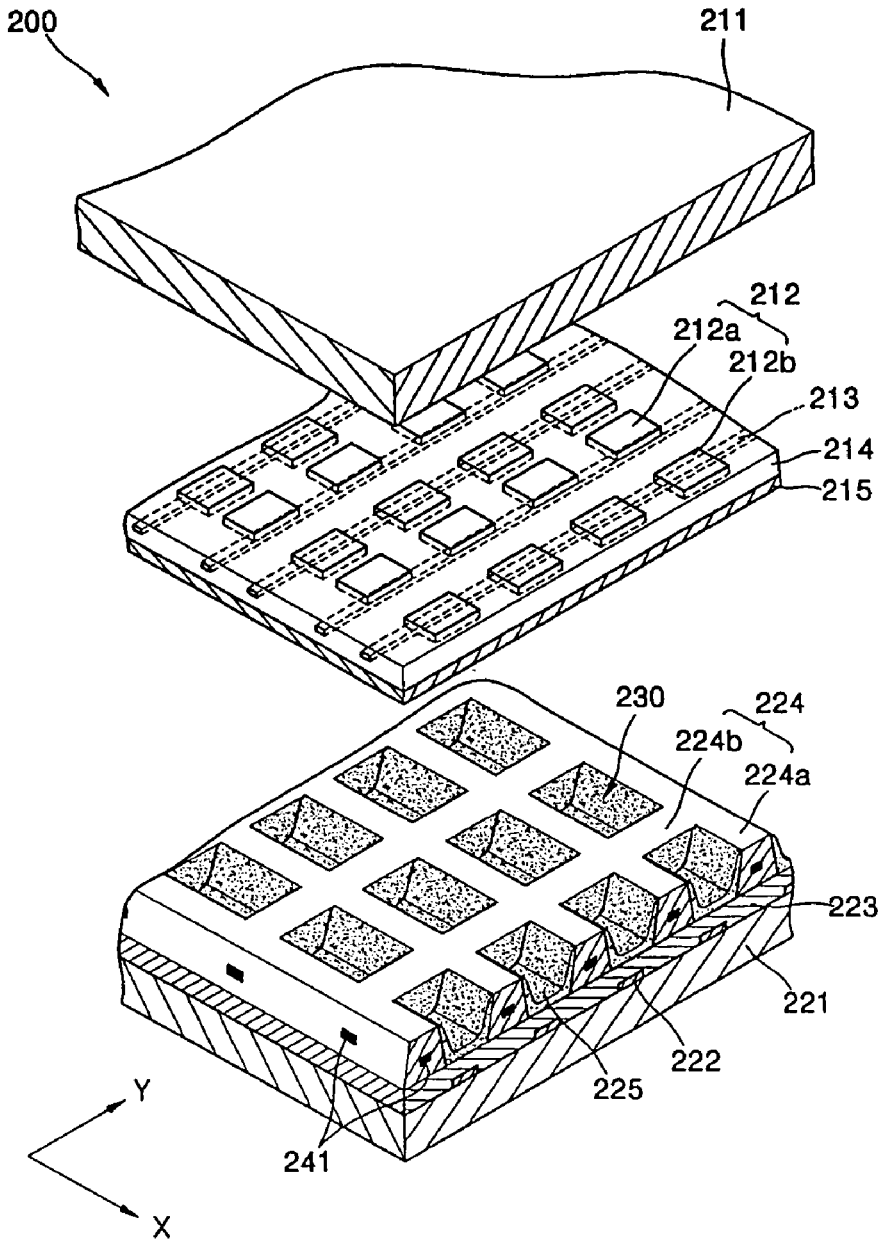
FIG. 4 is an exploded perspective view of a PDP according to a second embodiment of the present invention.

FIG. 4 shows a PDP according to the second embodiment of the present invention.

Referring to FIG. 4, similar to the PDP 100 of the first embodiment, a PDP 200 according to the second embodiment includes a front substrate 211 consisting of glass or a transparent material and a rear substrate 221 facing the front substrate 211.

Sustaining electrodes 212 are arranged on the bottom surface of the front substrate 211 and strip-shaped bus electrodes 213, having a narrower width than the sustaining electrodes 212, are arranged on the bottom surface of the sustaining electrodes 212. The sustaining electrodes 212 can consist of a transparent ITO film and the bus electrodes 213 can consist of a conductive material. Each sustaining electrode 212 can be divided into multiple sustaining electrodes which are connected to one bus electrode 213 and each is spaced apart at predetermined intervals along the longitudinal direction of the bus electrodes 213. The arrangement of sustaining electrodes is not limited thereto and can be arranged in other configurations.

The sustaining electrodes 212 include common electrodes 212*a* and scanning electrodes 212*b*. The common electrodes 212*a* and scanning electrodes 212*b* are arranged alternately, with one bus electrode 213 being connected to the common electrode 212*a* and an adjacent bus electrode 213 being connected to the scanning electrode 212*b*. The sustaining electrodes 212 and bus electrodes 213 are buried in the front dielectric layer 214 and a protective layer 215 is arranged under the front dielectric layer 214.

Strip-shaped address electrodes 222 are arranged on top of the rear substrate 221, which faces the front substrate 211, and are buried in the rear dielectric layer 223.

Address electrodes 222 are separated at predetermined intervals and are orthogonal to the bus electrodes 213. The structure of the electrodes is not limited thereto. For example, bus electrodes can be omitted, in which case, the sustaining electrodes are consecutively arranged and can play the role of a bus electrode.

Barrier walls 224 are arranged in a matrix on top of the rear dielectric layer 223. The barrier walls 224 partition discharge cells 230, which are discharge spaces arranged between the front substrate 211 and rear substrate 221.

The barrier walls 224 are spaced apart at predetermined intervals and include strip-shaped first barrier walls 224*a* and second barrier walls 224*b*, the second barrier walls 224*b* extending from the sides of the first barrier walls 224*a* in a direction perpendicular to the first barrier walls 224*a*. The first barrier walls 224*a* interpose the address electrodes 222 and are arranged in parallel with the address electrodes 222.

The second barrier walls 224*b* consist of the same material as that of the first barrier walls 224*a*. The structure of the barrier walls is not limited thereto and any barrier wall that has a structure partitioning the discharging cells into an arrangement of a pattern of pixels can be employed.

A fluorescent layer 225, consisting of one of red, green, and blue fluorescent substances, for example, is arranged in each discharge cell 230 partitioned by the first and second barrier walls 224*a* and 224*b*.

In addition, one of the address electrodes 222 is arranged on the bottom of the discharge cell 230, and one of the sustaining electrodes 212, consisting of a common electrode 212*a* and a scanning electrode 212*b* facing each other and spaced apart by predetermined non-contact intervals, is arranged on top of the discharge cell 230. Thus, a discharge can occur between the address electrodes 222 and the sustaining electrodes 212. It is preferable that the bus electrodes 213, connected to the sustaining electrodes 212, are arranged to correspond to the second barrier walls 224*b* and thus increase an aperture ratio.

According to an aspect of the present invention, at least one floating electrode 241, consisting of a conductive material, is buried in each of the first and second barrier walls 224*a* and 224*b*.

The floating electrodes 241 are buried in the first and second barrier walls 224*a* and 224*b* and it is preferable that strip-shaped floating electrodes 241 are arranged in the longitudinal direction of the first and second barrier walls 224*a* and 224*b*. It is also preferable that the floating electrodes 241 are formed simultaneously with the first and second barrier walls 224*a* and 224*b*. The floating electrodes are not limited thereto. As shown in the first embodiment illustrated in FIGS. 3B through 3D, a plurality of floating electrodes can be arranged in each of the first and second barrier walls 224*a* and 224*b*. At least one floating electrode can be included in the first or second barrier walls 224*a* or 224*b*.

Figure 5A:
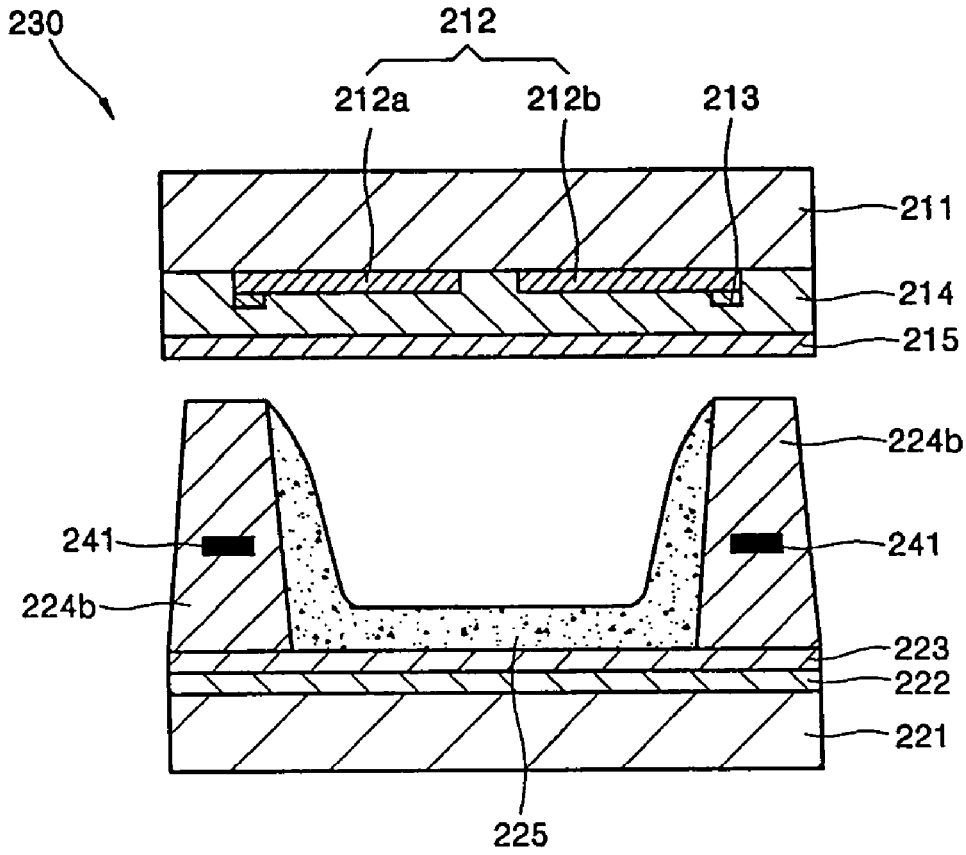
FIG. 5A is a cross-sectional view of the discharge cell cut in the X direction of FIG. 4.
Figure 5B:
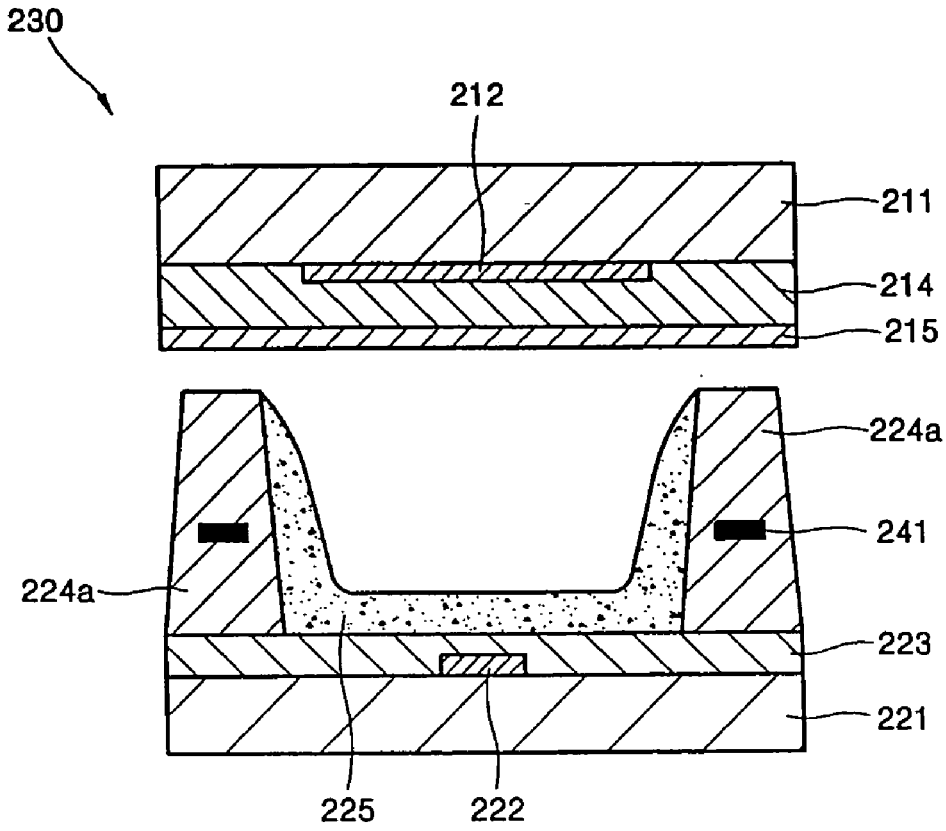
FIG. 5B is a cross-sectional view of the discharge cell cut in the Y direction of FIG. 4.

The cross-sectional views of the discharge cell in the X direction and Y direction are shown respectively in FIGS. 5A and 5B.

Referring to FIG. 5A, a discharge cell 230 is arranged between two second barrier walls 224*b*. Sustaining electrodes 212 arranged on the front substrate 211 and bus electrodes 213 arranged on the bottom surface of the sustaining electrodes 212 are arranged in the upper portion of the discharge cell 230. The sustaining electrodes 212 and bus electrodes 213 are buried in the front dielectric layer 214 and a protective layer 215 is arranged on the bottom surface of the front dielectric layer 214.

The rear substrate 221 is arranged to face the front substrate 211, and address electrodes 222 are arranged on the top of the rear substrate 221. The address electrodes 222 are buried under the rear dielectric layer 223.

Floating electrodes 241 are buried inside each of the second barrier walls 224*b* and along the longitudinal direction of the second barrier walls 224*b*.

As shown in FIG. 5B, in each first barrier wall 224*a*, which partitions discharge cells 230, one floating electrode 241 is buried along the longitudinal direction of the first barrier wall 224*a*.

The floating electrodes 241 arranged in the first barrier walls 224*a* and the floating electrodes 241 arranged in the second barrier walls 224*b* can be either formed separately without contact to each other or can be formed so as to be connected to each other. Since floating electrodes 241 are arranged within the first and second barrier walls 224*a* and 224*b*, the discharge cells 230 will be surrounded by the floating electrodes 241.

Since the discharge cell 230 includes floating electrodes 241, the movement of the large amount of space charges and priming particles created in the discharge cell 230 becomes active and the same effect can be achieved with half the voltage of the prior art applied to the sustaining electrodes 212 and address electrodes 222. As a result, addressing is possible at a low voltage.

In addition, unlike other arrangements, space electric charges and priming particles will not accumulate on the fluorescent layer 225 of the inner portion of the barrier walls 224 but due to the floating electrodes 241 will be distributed inside the discharge cell 230, preventing deterioration of the fluorescent layers 225. After-image, mis-discharge, and discharge interference are prevented, thereby enabling the achievement of excellent luminance. Also, since floating electrodes 241 are arranged within barrier walls 224, the supporting strength of the panel is increased. As described above, the PDP according to the present invention includes a floating electrode, which makes low voltage addressing possible and prevents deterioration of the fluorescent layers. Furthermore, the effect of increasing the supporting strength of the panel is achieved with the forming of floating electrodes within the barrier walls, in comparison with other arrangements.

While the present invention has been particularly shown and described with reference to exemplary embodiments thereof, it will be understood by those of ordinary skill in the art that various changes in form and details can be made therein without departing from the spirit and scope of the present invention as defined by the following claims.

What is claimed is:

1. A plasma display panel comprising:

a front substrate including sustaining electrodes arranged at predetermined intervals;

a front dielectric layer adapted to bury the sustaining electrodes;

a rear substrate arranged to face the front substrate and including address electrodes arranged orthogonal to the sustaining electrodes;

a rear dielectric layer adapted to bury the address electrodes;

barrier walls adapted to define stripe-shaped discharge spaces arranged between the front substrate and rear substrate, the stripe-shaped discharge spaces being arranged parallel to and alternating with the address electrodes;

fluorescent layers arranged within the discharge spaces; and at least one ungrounded floating electrode respectively arranged within the barrier walls and in a longitudinal direction of the barrier walls.

2. The plasma display panel of claim 1, wherein a plurality of floating electrodes are arranged at predetermined intervals in an upward and downward direction of the height of each barrier wall.

3. A plasma display panel comprising:

a front substrate including sustaining electrodes arranged at predetermined intervals;

a front dielectric layer adapted to bury the sustaining electrodes;

a rear substrate arranged to face the front substrate and including address electrodes arranged orthogonal to the sustaining electrodes;

a rear dielectric layer adapted to bury the address electrodes;

first and second barrier walls adapted to define discharge spaces arranged between the front substrate and rear substrate, the first barrier walls arranged parallel to and alternating with the address electrodes, and the second barrier walls arranged perpendicular to the first barrier walls;

fluorescent layers arranged within the discharge spaces; and at least one ungrounded floating electrode respectively arranged within the first and second barrier walls and in a longitudinal direction of the first and second barrier walls.

4. The plasma display panel of claim 3, wherein a plurality of floating electrodes are arranged at predetermined intervals in the first and second barrier walls in an upward and downward direction of the height of the first and second barrier walls.

5. The plasma display panel of claim 3, wherein floating electrodes are arranged within both the first and second barrier walls and wherein the floating electrodes arranged within the first barrier wall and the floating electrodes arranged within the second barrier wall are connected to each other.

6. The plasma display panel of claim 3, wherein floating electrodes are arranged within both the first and second barrier walls and wherein the floating electrodes arranged within the first barrier wall and the floating electrodes arranged within the second barrier wall are separated from each other.

7. The plasma display panel of claim 3, wherein the first and second barrier walls are arranged to partition the discharge space into a matrix form.

8. A plasma display panel comprising:

a front substrate including sustaining electrodes;

a rear substrate arranged to face the front substrate and including address electrodes;

barrier walls adapted to define discharge spaces arranged between the front substrate and rear substrate;

fluorescent layers arranged within the discharge spaces; and at least one ungrounded floating electrode respectively arranged within the barrier walls.

9. The plasma display panel of claim 8, wherein the at least one floating electrode is arranged within the barrier walls in a longitudinal direction of the barrier walls.

10. The plasma display panel of claim 8, wherein a plurality of floating electrodes are arranged at predetermined intervals in an upward and downward direction of the height of each barrier wall.

11. A plasma display panel comprising:

a front substrate including sustaining electrodes arranged at predetermined intervals;

a rear substrate arranged to face the front substrate and including address electrodes arranged orthogonal to the sustaining electrodes;

first and second barrier walls adapted to define discharge spaces arranged between the front substrate and rear substrate, the first barrier walls arranged in parallel and the second barrier walls arranged perpendicular to the first barrier walls;

fluorescent layers arranged within the discharge spaces; and at least one ungrounded floating electrode respectively arranged within the first and second barrier walls and in a longitudinal direction of the first and second barrier walls.

12. The plasma display panel of claim 11, wherein a plurality of floating electrodes are arranged at predetermined intervals in the first and second barrier walls in an upward and downward direction of the height of the first and second barrier walls.

13. The plasma display panel of claim 11, wherein floating electrodes are arranged within both the first and second barrier walls and wherein the floating electrodes arranged within the first barrier wall and the floating electrodes arranged within the second barrier wall are connected to each other.

14. The plasma display panel of claim 11, wherein floating electrodes are arranged within both the first and second barrier walls and wherein the floating electrodes arranged within the first barrier wall and the floating electrodes arranged within the second barrier wall are separated from each other.

15. The plasma display panel of claim 11, wherein the first and second barrier walls are arranged to partition the discharge space into a matrix form.

* * * * *